US010442095B2

(12) United States Patent
Shimizu et al.

(10) Patent No.: US 10,442,095 B2
(45) Date of Patent: Oct. 15, 2019

(54) ROTARY ELECTRIC SHAVER

(71) Applicant: Izumi Products Company, Matsumoto-shi, Nagano (JP)

(72) Inventors: Tetsuhiko Shimizu, Matsumoto (JP); Yoshiyuki Mimura, Matsumoto (JP)

(73) Assignee: MAXELL IZUMI CO., LTD., Matsumoto-Shi, Nagano (JP)

( * ) Notice: Subject to any disclaimer, the term of this patent is extended or adjusted under 35 U.S.C. 154(b) by 341 days.

(21) Appl. No.: 15/264,103

(22) Filed: Sep. 13, 2016

(65) Prior Publication Data

US 2017/0120465 A1 May 4, 2017

(30) Foreign Application Priority Data

Nov. 2, 2015 (JP) ..... 2015-215409

(51) Int. Cl.

*B26B 19/14* (2006.01)
*B26B 19/38* (2006.01)
*B26B 19/42* (2006.01)

(52) U.S. Cl.

CPC ..... *B26B 19/141* (2013.01); *B26B 19/143* (2013.01); *B26B 19/145* (2013.01); *B26B 19/3846* (2013.01); *B26B 19/42* (2013.01)

(58) Field of Classification Search

CPC ..... B26B 19/141; B26B 19/14; B26B 19/145
USPC ..... 30/43.6
See application file for complete search history.

(56) References Cited

U.S. PATENT DOCUMENTS 4,729,169 A * 3/1988 Asawa ..... B26B 19/141 30/346.51
2009/0025227 A1 1/2009 Minkes et al.

FOREIGN PATENT DOCUMENTS

| | | | |
|---|---|---|---|
| EP | 0019954 | A1 | 12/1980 |
| EP | 0566292 | A1 | 10/1993 |
| EP | 1537963 | A1 | 6/2006 |
| GB | 2008471 | A | 6/1979 |
| JP | 4971171 | B2 | 7/2012 |
| WO | WO 2006048799 | A1 | 5/2006 |

OTHER PUBLICATIONS

European Patent Office, "Communication with Extended European Search Report," issued in connection with European Patent Application No. 16196466.3, dated Oct. 3, 2017.

* cited by examiner

*Primary Examiner* — Kenneth E Peterson
(74) *Attorney, Agent, or Firm* — Birch, Stewart, Kolasch & Birch, LLP

(57) ABSTRACT

A rotary electric shaver includes an outer blade whose upper surface functions as annular shaving surfaces having multiple hair inlets formed therein, and an inner blade that has a small blade which rotates while coming into sliding contact with a lower surface of the outer blade. The small blade is formed so that an inner blade base plate is partially erected, and is disposed in at least two rows on a circumference close to an outer periphery and on a circumference close to an inner periphery. There is provided a movable inner blade that has a movable small blade which is vertically movable along a front end surface in a rotation direction of the small blade, with respect to the predetermined small blade.

3 Claims, 11 Drawing Sheets

X-X

ROTARY ELECTRIC SHAVER

CROSS-REFERENCE TO RELATED APPLICATION

This application is based upon and claims the benefit of priority of the prior Japanese Patent Application No. P2015-215409, filed on Nov. 2, 2015, and the entire contents of which are incorporated herein by reference.

TECHNICAL FIELD

The present invention relates to a rotary electric shaver.

BACKGROUND ART

In the related art, a rotary electric shaver is known which cuts hair entering multiple hair inlets while including an outer blade whose upper surface functions as annular shaving surfaces having the multiple hair inlets formed therein and an inner blade that has a small blade which rotates while coming into sliding contact with a lower surface of the outer blade.

As an example, PTL 1 discloses a rotary electric shaver including a hair pulling member cooperating with an inner blade, in addition to a normal inner blade. According to this disclosure, the hair is pulled by the hair pulling member. Accordingly, the hair can be cut at a position close to the skin by the inner blade.

CITATION LIST

Patent Literature

PTL 1: Japanese Patent No. 4971171

SUMMARY OF INVENTION

Technical Problem

However, as illustrated in FIG. 2 in PTL 1, the rotary electric shaver disclosed in PTL 1 is configured so that a cutter assembly (corresponding to an inner blade assembly) employs a total of five members such as a first cutting member, a second cutting member, the hair pulling member, a coupling member, and a cover plate. Consequently, the number of components increases, thereby inevitably increasing processing steps. Therefore, a structure and a processing method thereof become complicated, thereby causing a problem in that both component cost and manufacturing cost increase.

The present invention is made in view of the above-described circumstances, and an object thereof is to provide a rotary electric shaver which can realize a configuration having a movable small blade using a small number of components, and which enables deep shaving, even in a case where the rotary electric shaver has small blades in multiple tracks.

Solution to Problem

The object may be realized by providing embodiments disclosed hereinafter.

According to an embodiment, a disclosed rotary electric shaver includes an outer blade whose upper surface functions as annular shaving surfaces having multiple hair inlets formed therein, and an inner blade that has a small blade which rotates while coming into sliding contact with a lower surface of the outer blade from below the annular shaving surfaces. The small blade is formed so that an inner blade base plate is partially erected, and is disposed in at least two rows on a circumference close to an outer periphery and on a circumference close to an inner periphery. There is provided a movable inner blade that has a movable small blade which is vertically movable along a front end surface in a rotation direction of the small blade, with respect to the predetermined small blade. The inner blade and the movable inner blade are fixed to an inner blade base in this order from above so as to configure an inner blade assembly using the three components and so as to rotatably drive the inner blade assembly.

According to another embodiment, a disclosed rotary electric shaver includes an outer blade whose upper surface functions as annular shaving surfaces having multiple hair inlets formed therein, and an inner blade that has a small blade which rotates while coming into sliding contact with a lower surface of the outer blade from below the annular shaving surfaces. The small blade is formed so that an inner blade base plate is partially erected, and is disposed in at least two rows on a circumference close to an outer periphery and on a circumference close to an inner periphery. There are further provided a movable inner blade that has a movable small blade which is vertically movable along a front end surface in a rotation direction of the small blade, with respect to the predetermined small blade, and a stationary plate that comes into contact with a predetermined portion of the predetermined movable inner blade from below. The inner blade, the movable inner blade, and the stationary plate are fixed to an inner blade base in this order from above so as to configure an inner blade assembly using the four components and so as to rotatably drive the inner blade assembly.

In this invention, examples of the hair include beards, mustaches, whiskers, and the like.

Advantageous Effects of Invention

According to the present invention, even in a case where a small blade of an inner blade and a corresponding outer blade employ a multiple track structure such as a so-called dual track structure, it is possible to realize a configuration having a movable small blade using a small number of components. Therefore, the configuration can be simplified, and component cost and assembly cost can be decreased. In addition, the configuration including the movable small blade enables the small blade to cut hair entering a hair inlet after the hair is drawn further into the hair inlet compared to an initial hair entry state. Therefore, since deeper shaving is available, it is possible to prevent the hair from remaining unshaved, and it is possible to improve shaving comfortability.

DESCRIPTION OF EMBODIMENTS

First Embodiment

Figure 1:
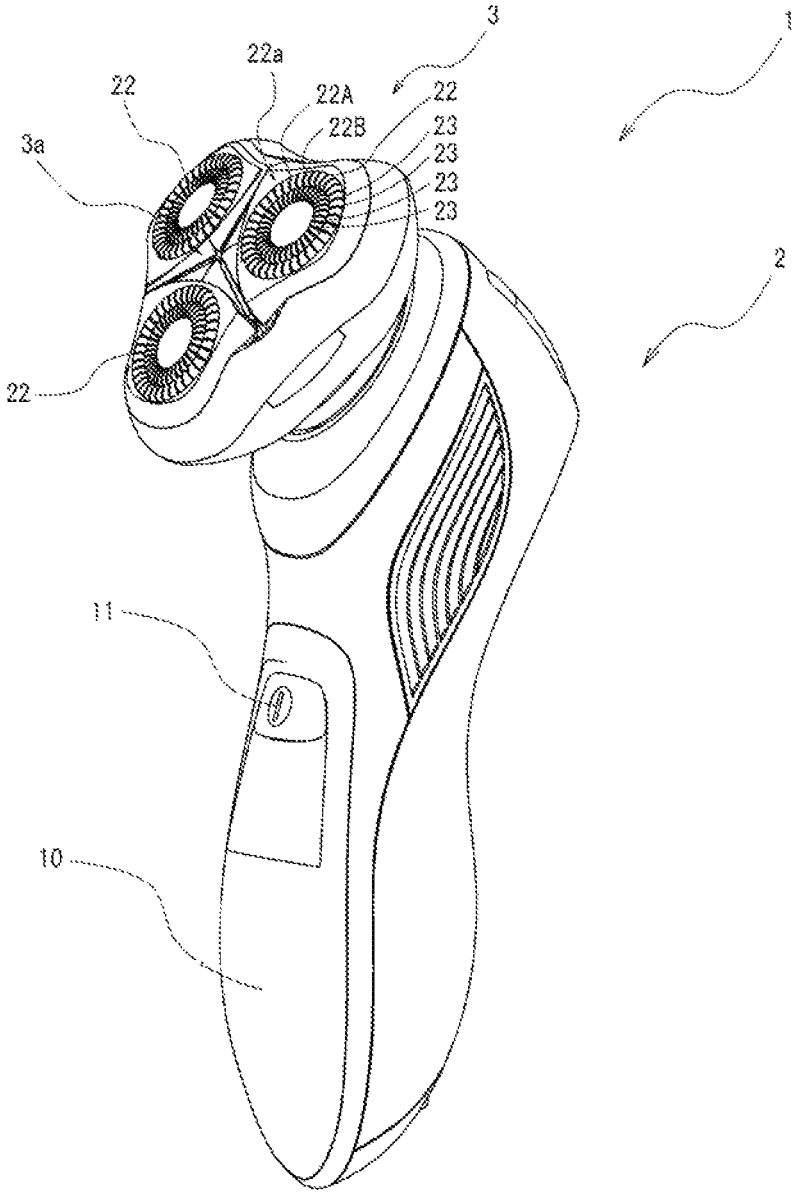
FIG. 1 is a schematic view (perspective view) illustrating an example of a rotary electric shaver according to a first embodiment of the present invention.
Figure 2:
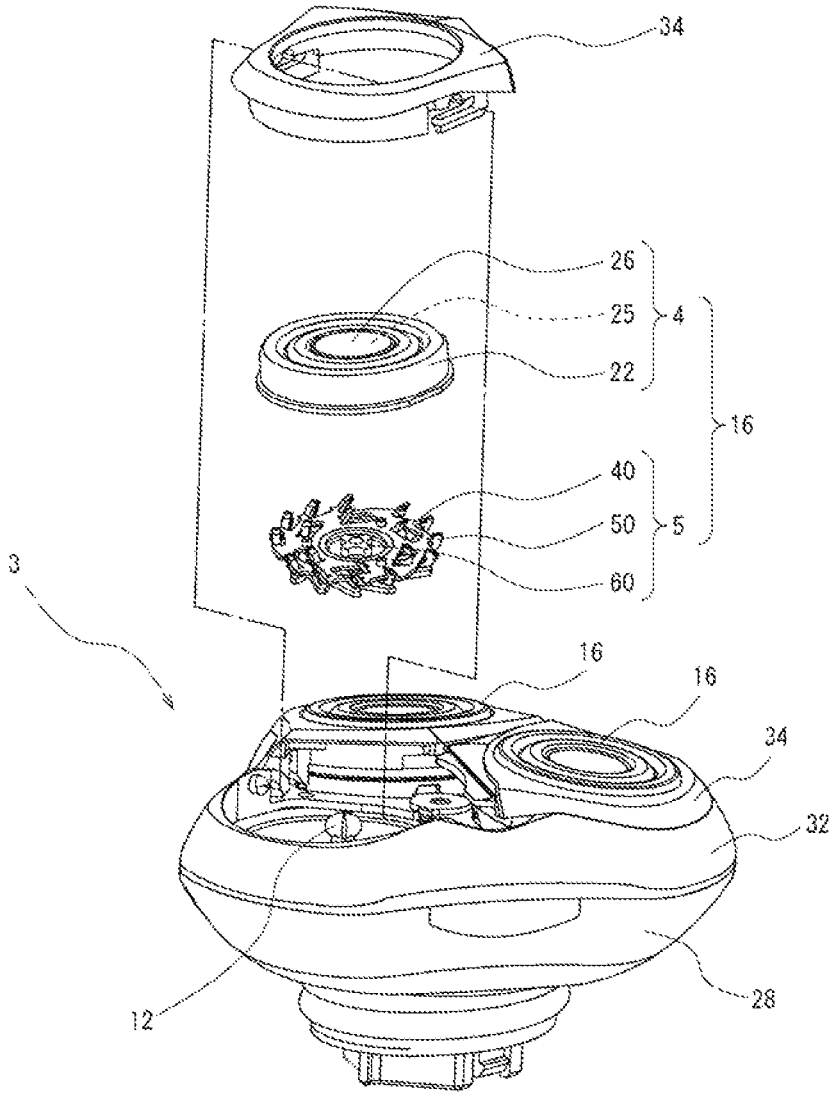
FIG. 2 is a schematic view (exploded perspective view) illustrating an example of a head unit of the rotary electric shaver illustrated in FIG. 1.

Hereinafter, referring to the drawings, a first embodiment according to the present invention will be described in detail. FIG. 1 is a schematic view (perspective view) illustrating an example of a rotary electric shaver 1 according to the present embodiment. In addition, FIG. 2 is a schematic view (exploded perspective view) illustrating an example of a head unit 3 of the rotary electric shaver 1. Referring to all drawings used in describing the embodiments, the same reference numerals will be given to members having the same function, and repeated description thereof will be omitted in some cases.

As illustrated in FIGS. 1 and 2, the rotary electric shaver 1 according to the present embodiment is configured so that the head unit 3 held in a main body 2 includes an outer blade 22 whose upper surface 22*a* functions as annular shaving surfaces (as an example, 22A and 22B) having multiple hair inlets 23 formed therein, and an inner blade 40 that has a small blade 42 which comes into sliding contact with a lower surface 22*b* of the outer blade 22. A configuration is adopted in which the inner blade 40 is rotatably driven so as to cut the hair entering the hair inlets 23 by using the outer blade 22 and the inner blade 40. In the present embodiment, an example will be described in which the rotary electric shaver has three sets of a blade unit 16 configured to include an outer blade assembly 4 having the outer blade 22, and an inner blade assembly 5 having the inner blade 40. However, the present invention is not limited thereto. In addition, a configuration may be adopted in which the outer blade is also rotatably driven together with the inner blade (not illustrated).

The main body 2 includes a substantially cylindrical case 10. A drive source (as an example, a motor), a battery, and a control circuit board (all not illustrated) are accommodated inside the case 10. In addition, a power switch 11 is attached to a front surface of the case 10.

As illustrated in FIG. 2, the head unit 3 includes a head case 28 which is held by being connected to an upper portion of the case 10 in the main body 2, an outer blade frame 32 which covers the head case 28 from above, an inner blade drive shaft 12 which is accommodated in an inner bottom portion of the head case 28, and three sets of the blade unit 16 which are held in the outer blade frame 32 so as to be slightly and vertically movable and swingable. In addition, three sets of the blade unit 16 are arranged so as to form a triangle in a plan view. As described above, the present embodiment employs a case example where three sets of the blade unit 16 are included therein. However, a basic configuration may be similarly conceivable even in a case where blade units are included in an alternative combination other than three sets.

Figure 3:
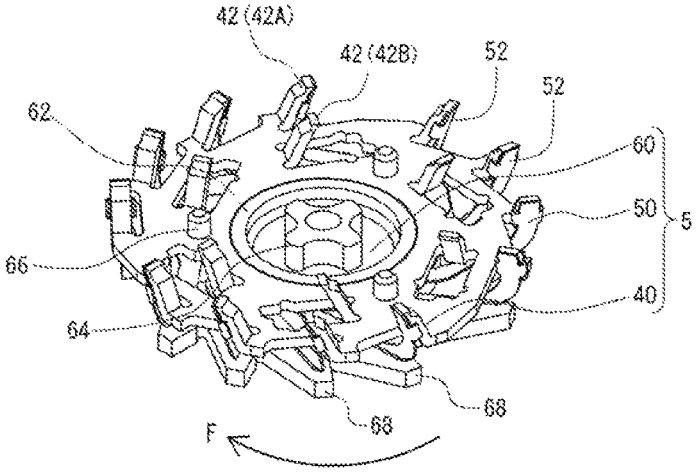
FIG. 3 is a schematic view (perspective view) illustrating an example of an inner blade assembly of the rotary electric shaver illustrated in FIG. 1.
Figure 4:
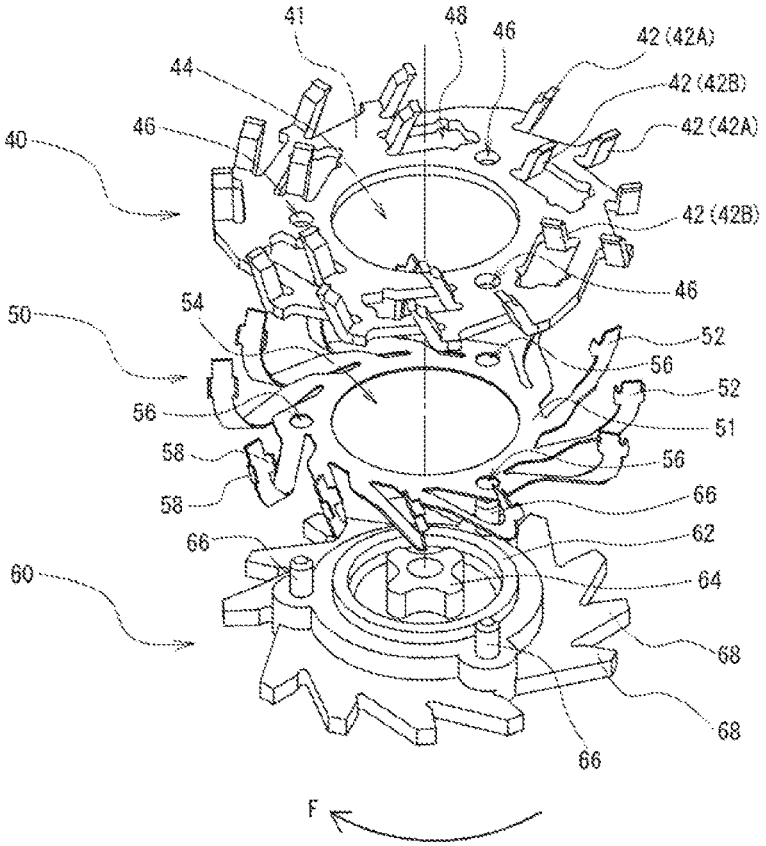
FIG. 4 is an exploded view of the inner blade assembly illustrated in FIG. 3.
Figure 5:
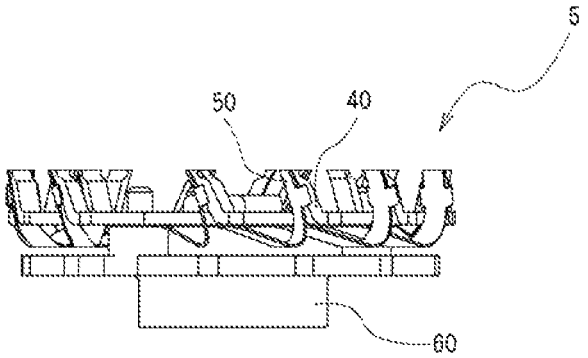
FIG. 5 is a schematic view (front view) illustrating an example of the inner blade assembly of the rotary electric shaver illustrated in FIG. 1.
Figure 6:
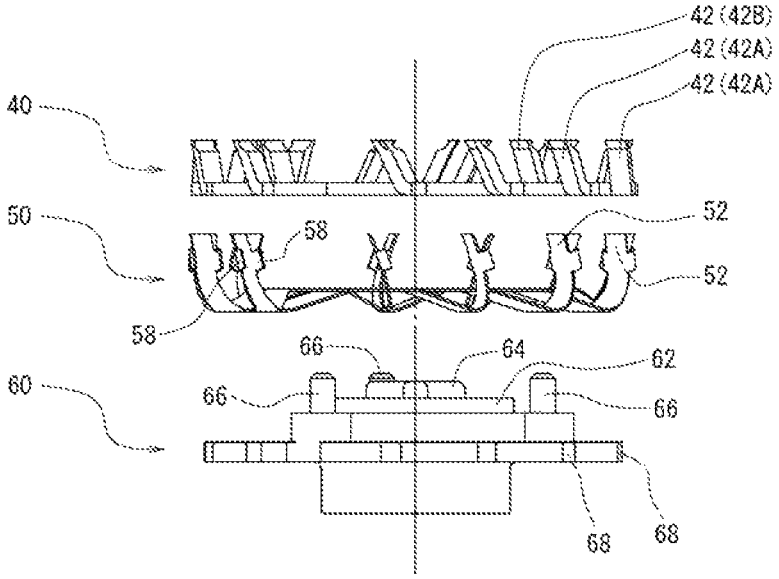
FIG. 6 is an exploded view of the inner blade assembly illustrated in FIG. 5.

First, a configuration of the inner blade assembly 5 in the blade unit 16 will be described with reference to FIGS. 3 to 6. Here, FIG. 3 is a perspective view (schematic view) illustrating an example of the inner blade assembly 5. FIG. 4 is an exploded view (schematic view) thereof. FIG. 5 is a front view (schematic view) of the inner blade assembly 5. FIG. 6 is an exploded view (schematic view) thereof. Here, in each drawing, a rotation direction of the inner blade 40 is illustrated as a direction of an arrow F.

The inner blade assembly 5 according to the present embodiment is configured to include only three components in such a way that the inner blade 40 and a movable inner blade 50 are fixed to an inner blade base 60 in this order from above. That is, since the configuration employing the three components as a minimum unit can be adopted, compared to the related art, the number of components can be greatly decreased to approximately three-fourths or three-fifths. Therefore, the configuration can be simplified, and component cost and assembly cost can be decreased.

Figure 7:
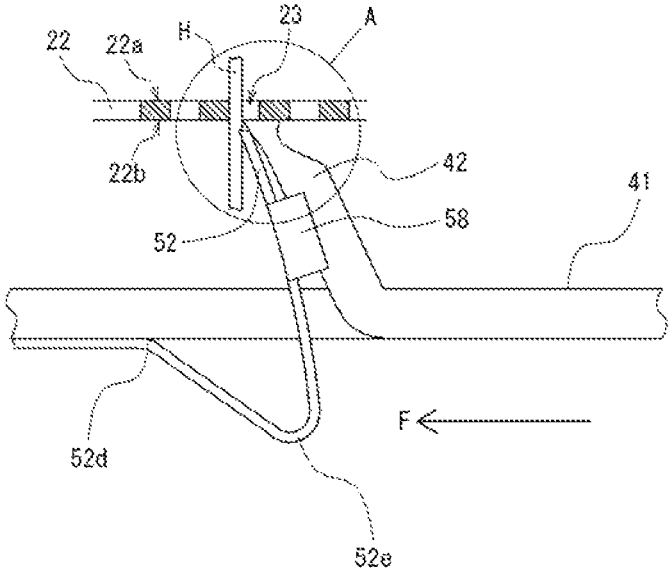
FIG. 7 is a front enlarged view illustrating a small blade of an inner blade and a portion of an outer blade in the rotary electric shaver illustrated in FIG. 1.
Figure 8A:
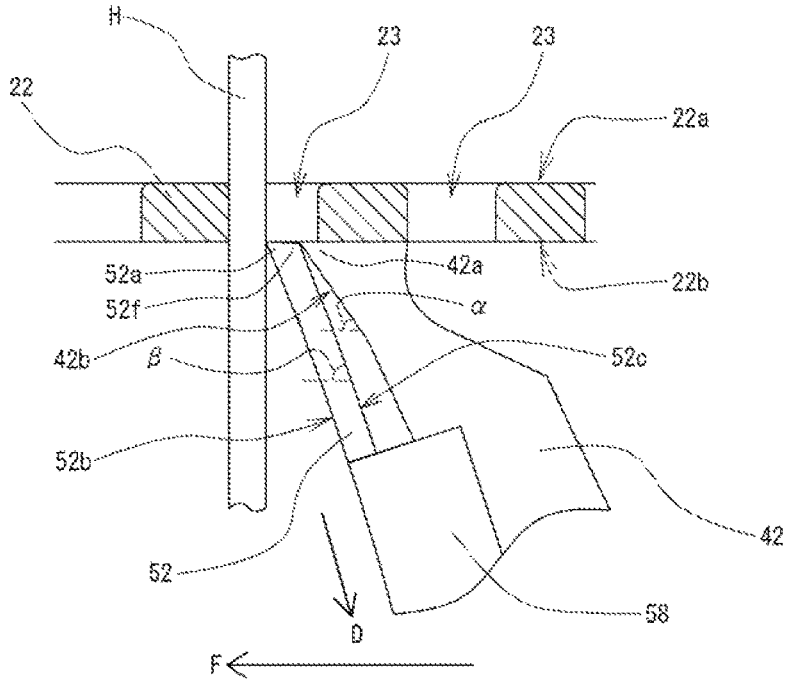
FIGS. 8A and 8B are views for describing an operation by illustrating an enlarged portion A in FIG. 7.
Figure 8B:
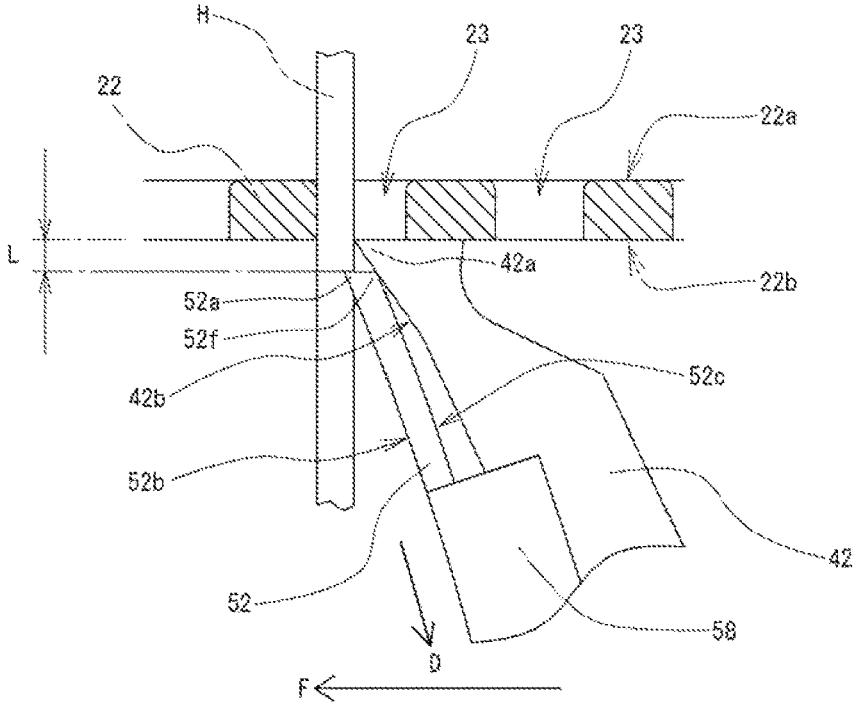

According to the present embodiment, the inner blade 40 is formed as an integral structure by using a flat plate-shaped metal plate made of a stainless steel alloy and by performing die-cutting and bending through press work. In this way, the inner blade 40 can be formed to have a simple structure by performing fewer processes. Accordingly, it is possible to decrease component cost and assembly cost. However, a configuration is not limited to the integral structure. Here, FIG. 7 is a front enlarged view illustrating the small blade 42 of the inner blade 40 and a portion of the outer blade 22. FIGS. 8A and 8B are views for describing an operation by illustrating an enlarged portion A in FIG. 7.

More specifically, the inner blade 40 is configured to include the multiple small blades 42 in which an inner blade base plate 41 having a substantially disc-shaped flat plate is partially erected from a plate surface (in order to simplify the drawings, the reference numerals are given to only a few of the small blades). As an example, the small blade 42 is formed so that a front end surface 42*b* tilts forward in the rotation direction. Therefore, a front side upper end edge in the rotation direction functions as a blade edge 42*a*.

The inner blade 40 according to the present embodiment adopts a so-called dual track configuration in which the small blades 42 are disposed in two rows on a circumference close to an outer periphery and on a circumference close to an inner periphery. However, without being limited thereto, other configurations, such as triple tracks in which the small blades 42 are disposed in three rows, may be adopted (not illustrated).

The small blade 42 according to the present embodiment is formed so that the widths in the radial direction from the upper end to the lower end are equal. As an example, the small blade 42 has a substantially prismatic shape having a rectangular cross section in which the width in the radial direction is approximately 1 mm and the width in the circumferential direction is approximately 0.5 mm. The small blade 42 is formed so that the length (length from the base to the blade edge) is approximately 3 mm. However, the dimensional shape is not limited thereto.

Next, similarly to the inner blade 40, the movable inner blade 50 according to the present embodiment is formed as an integral structure by using a flat plate-shaped metal plate made of a stainless steel alloy and by performing die-cutting and bending through press work. However, the movable inner blade 50 employs a metal plate which is thinner than that of the inner blade 40 (for example, the thickness of approximately 0.1 mm).

More specifically, the movable inner blade 50 is configured to include multiple movable small blades 52 in which a movable inner blade base plate 51 having a substantially disc-shaped flat plate is partially erected from a plate surface (in order to simplify the drawings, the reference numerals are given to only a few of the movable small blades). As an example, as illustrated in FIG. 7, the movable small blade 52 is formed by being bent downward in a base portion 52*d* and being bent upward and erected in an intermediate portion 52*e* so that a front end surface 52*b* tilts forward in the rotation direction. Therefore, a front side upper end edge in the rotation direction functions as a blade edge 52*a*.

The movable inner blade 50 (that is, the movable small blade 52) provided with the above-described configuration is elastically deformable. More specifically, a biasing operation using an elastic force brings the movable small blade 52 into a state of being closely attached to (in contact with) the front end surface 42*b* in the rotation direction of the small blade 42 (in the present embodiment, the small blade 42A arranged on the circumference close to the outer periphery) located at a predetermined position in the inner blade 40. Furthermore, in this state, the movable small blade 52 is vertically movable (slidable) along the front end surface 42*b* (the operation will be described later).

According to the present embodiment, the movable small blade 52 is configured so that a width in the radial direction of the upper end of the movable small blade 52 is equal to a width in the radial direction of the upper end of the small blade 42, and that plate-shaped extension portions 58 and 58 which extend in the radial direction while being disposed between the upper end and the lower end (here, the intermediate portion 52*e* which is the lower end of the movement) of the movable small blade 52 is bent in a circumferential direction so as to pinch both end surfaces in the radial direction of the small blade 42, thereby enabling the movable small blade 52 to move in the vertical direction without being deviated in the radial direction in a state of being positioned in the radial direction along both end surfaces in the radial direction of the small blade 42 whose widths in the radial direction from the upper end to the lower end are formed to be equal.

A specific operation of the movable small blade 52 will be described. As illustrated in FIG. 8A, a normal position of the movable small blade 52 during rotation is arranged so that respective upper end surfaces of the small blade 42 and the movable small blade 52 are located at the same height. Next, as illustrated in FIG. 8B, if the movable small blade 52 is progressively rotated and touches hair H entering the hair inlet 23, a front side upper end edge of the movable small blade 52 (blade edge 52*a* of the movable small blade) catches the hair H. In this state, the movable small blade 52 moves downward (in the direction of the arrow D), thereby performing an operation for drawing the hair H downward. In this case, a downward drawing amount L of the hair H is approximately 0.2 mm as an example. Subsequently, the blade edge 42*a* of the small blade 42 cuts the hair H by coming into contact with the hair H. After the hair H is cut, the movable small blade 52 moves upward (direction opposite to the arrow D) along the front end surface 42*b* in the rotation direction of the small blade 42 due to its own elastic force, thereby returning to a state illustrated in FIG. 8A.

In this way, the hair H entering the hair inlet 23 can be cut by the small blade 42 after the hair H is further drawn by the movable small blade 52, compared to the initial entry state. Therefore, since deeper shaving is available, it is possible to prevent the hair H from remaining unshaved, and it is possible to improve shaving comfortability.

Here, according to the present embodiment, an angle $\alpha$ of an erected angle of the front end surface 42*b* in the rotation direction with respect to a plate surface of the inner blade base plate 41 in the small blade 42 is formed relatively small, and an angle $\beta$ of an erected angle of a rear end surface 52*c* in the rotation direction with respect to a plate surface of the movable inner blade base plate 51 in the movable small blade 52 is formed relatively large. Therefore, the movable small blade 52 can be moved in the vertical direction with respect to the small blade 42 in a state where a rear side upper end edge 52*f* in the rotation direction of the movable small blade 52 is always in linear contact with the front end surface 42*b* in the rotation direction of the small blade 42. According to this configuration, compared to a surface contact configuration, contact resistance can be reduced between the movable small blade 52 and the small blade 42, and a contact area is not changed during the movement process. Therefore, the movable small blade 52 can be smoothly moved. In addition, it is possible to reduce abrasion of the movable small blade 52 and the small blade 42.

Next, the inner blade base 60 according to the present embodiment is formed using a resin material. A concave portion 60*a* with which an upper end (spherical portion) of the inner blade drive shaft 12 engages is formed in a lower portion of the inner blade base 60. The upper end (spherical portion) of the inner blade drive shaft 12 enters the concave portion 60*a* from below. Both of these engage with each other so as to be slidable, and a drive force is transmitted therebetween. However, the engagement structure is only an example, and other joint structures may be employed.

The inner blade drive shaft 12 is a member which rotatably drives the inner blade 40 by transmitting a drive force of a drive source (motor). The inner blade drive shaft 12 according to the present embodiment adopts a configuration in which a spherical portion is provided in the upper end and a coil spring (not illustrated) is internally compressed so as to generate a returning tendency in an extending direction thereof. The returning tendency functions as a pressing force of the inner blade 40 against the outer blade 22.

On the other hand, a first projection 62 in which the inner blade 40 and the movable inner blade 50 are fitted to each other so that both of these are positioned in the radial direction, and a second projection 64 in which the outer blade 22 and the outer blade assembly 4 having the outer blade cover 25 (details will be described later) are fitted to each other so that both of these are positioned in the radial direction are disposed in the upper portion of the inner blade base 60. Furthermore, multiple third projections 66 are disposed therein which are erected radially outward from the first projection 62 and which fix the inner blade 40 and the movable inner blade 50 to the inner blade base 60.

The first projection 62 is formed in an annular shape (as an example, a cylindrical shape). In addition, the second projection 64 is formed in a pillar shape (as an example, a pillar shape with a cross shape in a plan view). Here, the second projection 64 is arranged at the center of the first projection 62. Respective center axes of the first projection 62 and the second projection 64 are arranged so as to be coaxial with a rotary shaft of the inner blade assembly 5. In addition, the third projection 66 is formed in a pillar shape (as an example, a cylindrical shape), and is arranged at multiple locations (as an example, three locations).

With regard to an assembly configuration, first, the first projection 62 of the inner blade base 60 is internally fitted from below into a fitting hole 54 formed at the center in the radial direction of the movable inner blade 50. Furthermore, in this state, the first projection 62 is internally fitted from below into a fitting hole 44 formed at the center in the radial direction of the inner blade 40. In this manner, in a state where the center of the inner blade base 60, the center of the movable inner blade 50, and the center of the inner blade 40 are aligned with each other, the three members are fitted while being restrained from moving (positioned) in the radial direction.

In this case, the third projection 66 is inserted from below into a through-hole 56 formed at a corresponding position in the movable inner blade base plate 51 of the movable inner blade 50. Furthermore, in a state where the third projection 66 is inserted from below into a through-hole 46 formed in the inner blade base plate 41 of the inner blade 40, the inner blade 40, the movable inner blade 50, and the inner blade base 60 are fixed by means of caulking (swaging), thereby configuring the inner blade assembly 5. The inner blade base 60 (third projection 66) is formed using a resin material. Accordingly, the caulking in this case is thermal caulking.

In addition, multiple guard portions 68 extending in the radial direction are disposed in the outer periphery of the inner blade base 60. The guard portions 68 are disposed at a position directly below the intermediate portion 52*e* which is the lower end of the movement when the movable small blade 52 is moved in the vertical direction. According to this configuration, it is possible to prevent the movable small blade 52 from moving downward beyond a predetermined range. In particular, it is possible to prevent the movable small blade 52 from being deformed after moving to a plastic region.

Figure 9:
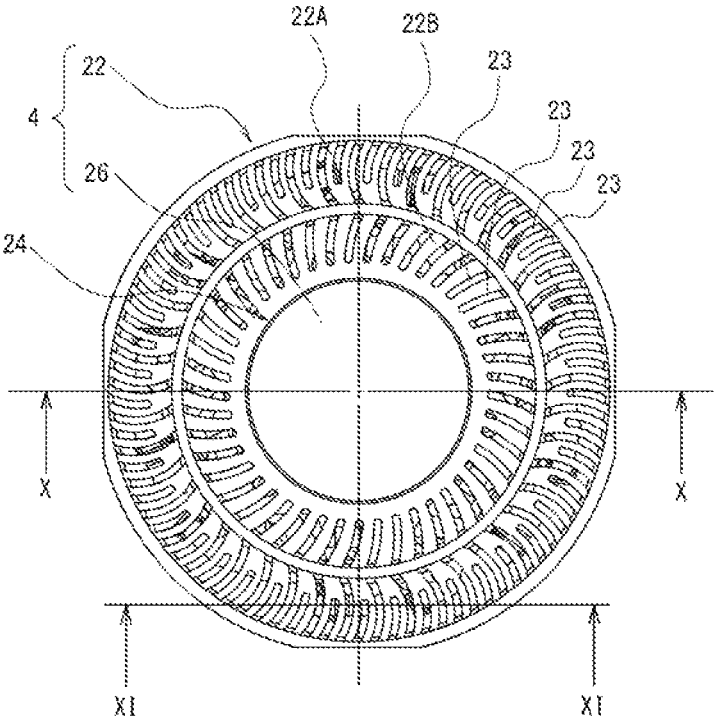
FIG. 9 is a schematic view (plan view) illustrating an example of an outer blade assembly in a state where the inner blade assembly of the rotary electric shaver illustrated in FIG. 1 is incorporated.
Figure 10:
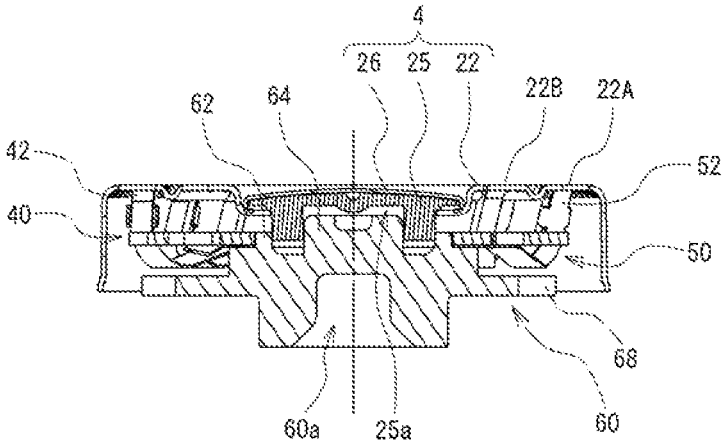
FIG. 10 is a sectional view taken along line X-X in FIG. 9.
Figure 11:
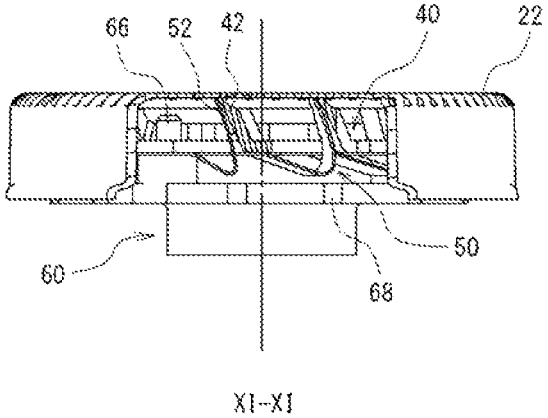
FIG. 11 is a sectional view taken along line XI-XI in FIG. 9.

Next, the outer blade assembly 4 will be described. The outer blade assembly 4 according to the present embodiment is configured so that the outer blade cover 25 is fixed to the center of the outer blade 22. Here, FIGS. 9 to 11 illustrate a schematic view of the outer blade assembly 4 in a state where the inner blade assembly 5 is incorporated.

According to the present embodiment, the outer blade 22 is formed as an integral structure by using a flat plate-shaped metal plate made of a stainless steel alloy and by performing die-cutting and bending through press work. The outer blade 22 has a substantially cup shape whose peripheral edge is bent downward. In addition, the multiple hair inlets 23 are formed on the upper surface 22*a* (that is, by penetrating from the upper surface 22*a* to the lower surface 22*b*). In this manner, an operation for cutting the hair entering the hair inlets 23 can be performed by interposing the hair between the lower end portion of the hair inlets 23 and the inner blade 40 (small blade 42). The hair inlets 23 can employ various shapes such as a radially slit shape and a round hole shape, or a combination thereof.

Figure 12:
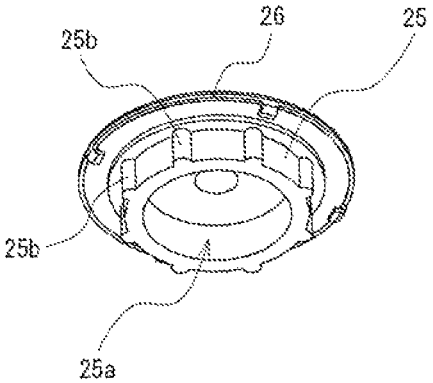
FIG. 12 is a schematic view (perspective view) illustrating an example of an outer blade cover of the outer blade assembly illustrated in FIG. 9.

On the other hand, as illustrated in FIG. 12, the outer blade cover 25 is formed in a substantially cup shape by using a resin material, and a lower portion thereof has a cylindrical portion 25*a* with which the second projection 64 of the inner blade base 60 engages. In addition, multiple projection portions 25*b* to be fitted and fixed by caulking to a fitting hole 24 formed at the center in the radial direction of the outer blade 22 are disposed on an outer wall portion of the cylindrical portion 25*a*. In this manner, in a state where the center of the outer blade 22 is aligned with the center of the outer blade cover 25 (here, the cylindrical portion 25*a*), both of these are fitted to each other, thereby configuring the outer blade assembly 4. A decorative plate 26 made of a metal material such as a stainless steel alloy is fitted to an upper portion of the outer blade cover 25. However, a configuration may be adopted by omitting the decorative plate 26.

When being assembled, the second projection 64 of the inner blade base 60 is internally fitted from below into the cylindrical portion 25*a* formed at the center in the radial direction of the outer blade cover 25. In this manner, in a state where the center of the inner blade base 60 is aligned with the center of the outer blade cover 25, both of these are restrained from moving (positioned) in the radial direction, and are fitted to each other. That is, in a state where the center of the inner blade assembly 5 is aligned with the center of the outer blade assembly 4, both of these are restrained from moving (positioned) in the radial direction, and are fitted to each other. However, in this case, the outer blade cover 25 is movable in the vertical direction with respect to the inner blade base 60 (here, the second projection 64).

In a state where the inner blade assembly 5 and the outer blade assembly 4 are fitted to each other in this way, the outer blade case 34 is fitted thereto from above, and is fixed to (held in) the outer blade frame 32 so as to be swingable and vertically movable. In this case, the upper end (spherical portion) of the inner blade drive shaft 12 engages from below with the concave portion 60*a* disposed in the lower portion of the inner blade base 60, and the inner blade assembly 5 is rotatably driven by driving the inner blade drive shaft 12.

In addition, in the present embodiment, the respective outer blade cases 34 are configured to be respectively swingable with respect to the outer blade frame 32 in a seesaw-like manner while both of these are interlocked to each other. In this manner, the upper surface 3*a* of the head unit 3 is deformable between a convex surface state and a concave surface state.

According to the above-described configuration, the inner blade 40 is rotatably driven, thereby enabling the blade edge of the small blade 42 of the inner blade 40 to cut the hair while the hair entering the hair inlets 23 is pulled down by the movable small blade 52 of the movable inner blade 50.

Second Embodiment

Subsequently, the rotary electric shaver 1 according to a second embodiment of the present invention will be described. The rotary electric shaver 1 according to the present embodiment has a basic configuration which is the same as that according to the above-described first embodiment. However, there is a different point in the inner blade assembly 5, particularly, a configuration of the movable inner blade 50. Hereinafter, the different point of the present embodiment will be mainly described.

Figure 13:
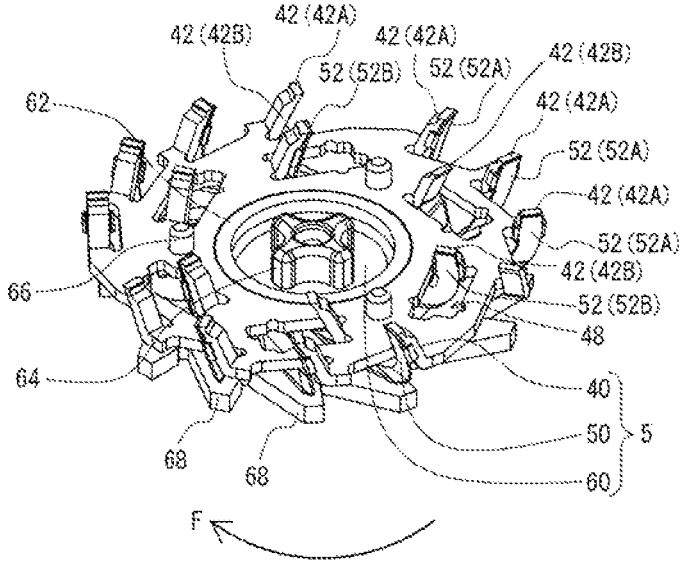
FIG. 13 is a schematic view (perspective view) illustrating an example of an inner blade assembly of a rotary electric shaver according to a second embodiment of the present invention.

FIG. 13 illustrates a perspective view (schematic view) of the inner blade assembly 5 of the rotary electric shaver 1 according to the present embodiment.

In the rotary electric shaver 1 according to the present embodiment, the movable small blades 52 of the movable inner blade 50 are alternately arranged as many as every predetermined number for a small blade 42A close to the outer periphery and a small blade 42B close to the inner periphery in the inner blade 40. As an example, as illustrated in FIG. 13, a configuration is repeatedly adopted in which after a movable small blade 52A is disposed corresponding to three small blades 42A along the circumferential direction, a movable small blade 52B is disposed corresponding to one small blade 42B. In this manner, a configuration is adopted in which the movable small blades 52 are alternately arranged to be close to the outer periphery and to be close to the inner periphery.

In the related art, with regard to the inner blade provided with a dual track configuration, a configuration has not been realized in which the movable small blade is disposed corresponding to the small blade 42B close to the inner periphery. The reason is that there is a problem of how to dispose the movable small blades corresponding to the small blade 42B close to the inner periphery so as to extend along the small blade 42B close to the inner periphery.

In this regard, according to the present embodiment, first, the movable small blade 52A close to the outer periphery and the movable small blade 52B close to the inner periphery are alternately arranged as many as a predetermined number. In this manner, the respective movable small blades 52A and 52B for outer periphery and the inner periphery can be formed using one sheet of metal plate. That is, without using other members, the movable small blade 52B for the inner periphery can be formed. Furthermore, when the targeted small blade 42B is erected, the corresponding movable small blade 52B is inserted from below into a hole 48 punched in the inner blade base plate 41. In this manner, a configuration is realized in which the movable small blade 52B is closely attached to the small blade 42B.

Therefore, in the dual track configuration, it is possible to realize a configuration in which the movable small blades 52 are respectively disposed in the small blade 42A close to the outer periphery and the small blade 42B close to the inner periphery. Therefore, deep shaving is available in the wider range, and the hair can be prevented from remaining unshaved.

Third Embodiment

Subsequently, the rotary electric shaver 1 according to a third embodiment of the present invention will be described. The rotary electric shaver 1 according to the present embodiment has a basic configuration which is the same as that according to the above-described first embodiment. However, there is a different point in the inner blade assembly 5, particularly, a configuration which further includes a stationary plate 70. Hereinafter, the different point of the present embodiment will be mainly described. Repeated description with regard to the common operation and advantageous effect will be omitted.

Figure 14:
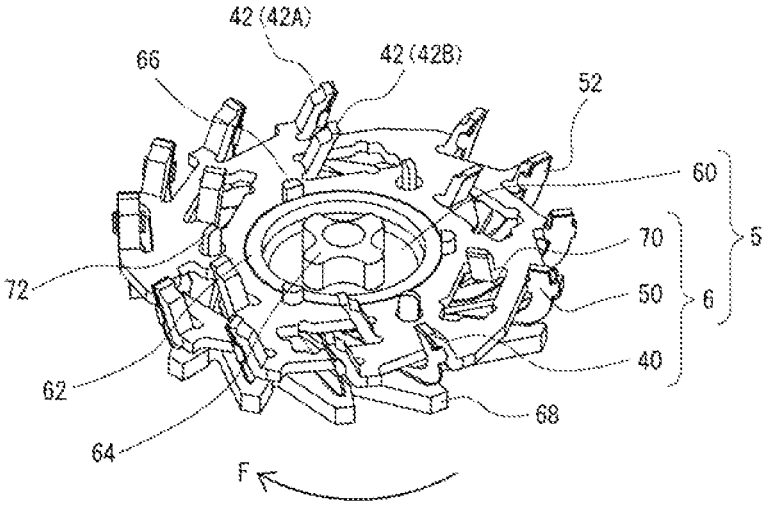
FIG. 14 is a schematic view (perspective view) illustrating an example of an inner blade assembly of a rotary electric shaver according to a third embodiment of the present invention.
Figure 15:
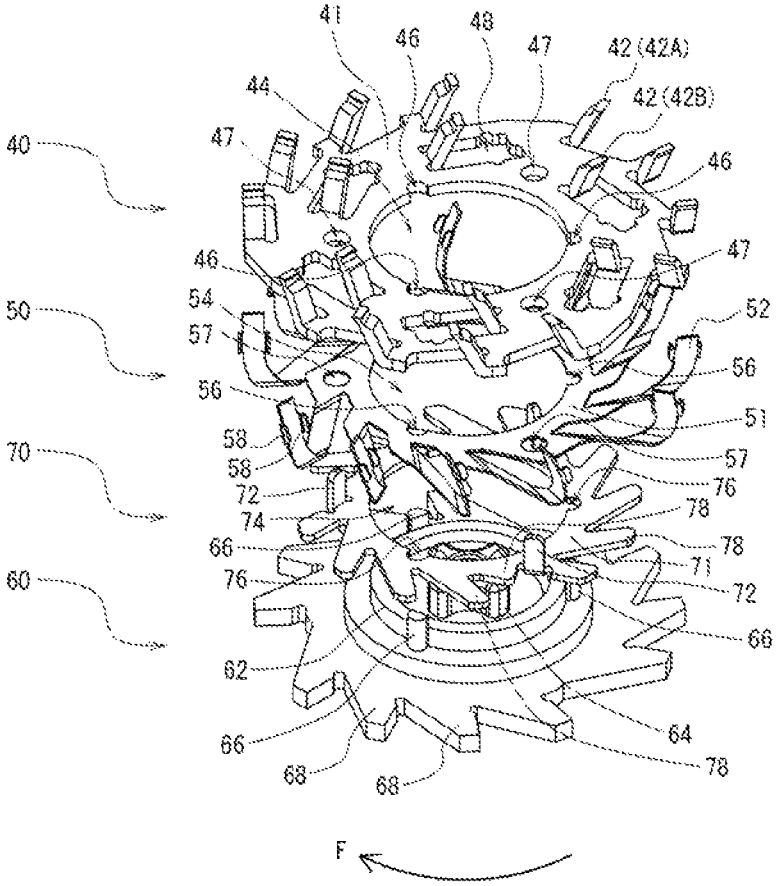
FIG. 15 is an exploded view of the inner blade assembly illustrated in FIG. 14.
Figure 16:
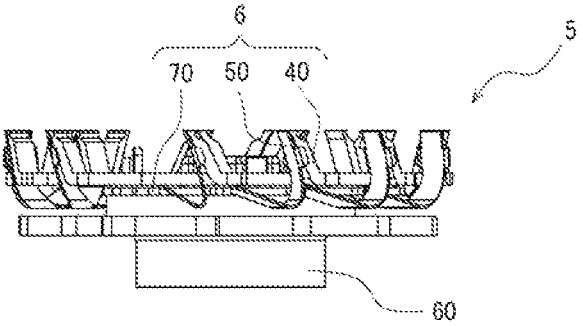
FIG. 16 is a schematic view (front view) illustrating an example of the inner blade assembly of the rotary electric shaver illustrated in FIG. 14.
Figure 17:
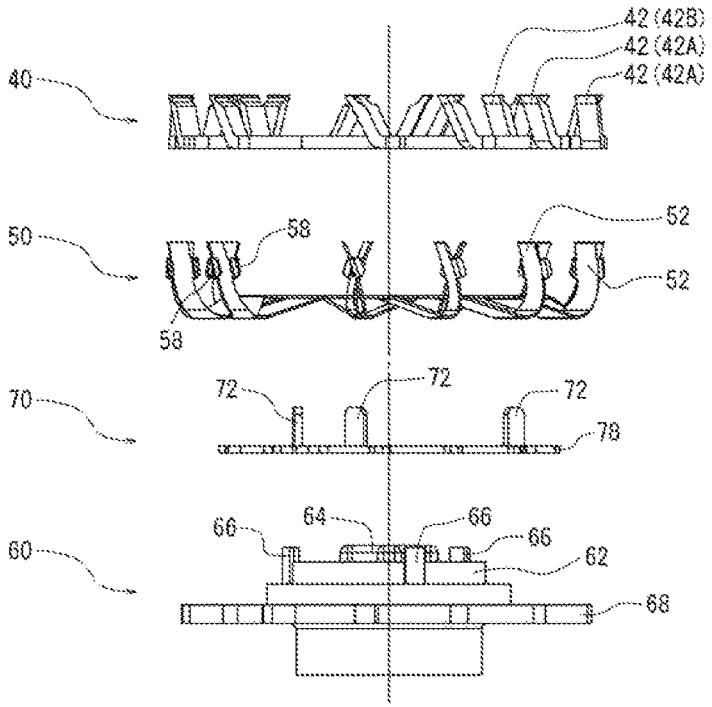
FIG. 17 is an exploded view of the inner blade assembly illustrated in FIG. 16.
Figure 18:
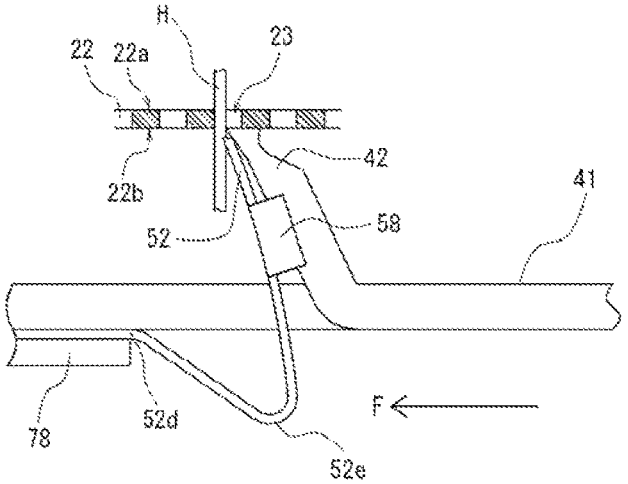
FIG. 18 is a front enlarged view illustrating a small blade of an inner blade, a stationary plate, and a portion of an outer blade in the rotary electric shaver illustrated in FIG. 14.

Here, FIG. 14 is a perspective view (schematic view) of the inner blade assembly 5, and FIG. 15 is an exploded view (schematic view) thereof. In addition, FIG. 16 is a front view (schematic view) of the inner blade assembly 5, and FIG. 17 is an exploded view (schematic view) thereof. FIG. 18 is a front enlarged view of the small blade 42 of the inner blade 40, the outer blade 22, and the stationary plate 70.

First, the inner blade 40 according to the present embodiment adopts a so-called dual track configuration in which the small blades 42 are disposed in two rows on the circumference close to the outer periphery and on the circumference close to the inner periphery. However, without being limited thereto, other triple track configurations may be adopted in which the small blades 42 are disposed in three rows. Triple or more track configurations may also be adopted (not illustrated).

Next, as an example, the stationary plate 70 according to the present embodiment is formed as an integral structure by using a flat plate-shaped metal plate made of a stainless steel alloy and by performing die-cutting and bending through press work. For example, a metal plate having the thickness of approximately 0.3 mm is used.

More specifically, the stationary plate 70 has multiple engagement claws 72 in which a stationary plate base plate 71 having a substantially disc-shaped flat plate is partially erected from a plate surface and projected upward. Furthermore, the stationary plate 70 has multiple extension portions 78 extending in the radial direction. The extension portions 78 are configured to come into contact with a predetermined portion of each movable inner blade 50 (base portion 52*d* of the movable small blade 52 or the vicinity thereof) from below.

Next, the inner blade assembly 5 according to the present embodiment is configured to include only four components in such a way that the inner blade 40, a movable inner blade 50, and the stationary plate 70 are fixed to an inner blade base 60 in this order from above. That is, since the configuration employing the four components as a minimum unit can be adopted, compared to the related art, for example, the rotary electric shaver disclosed in PTL 1 which has the dual track structure, the number of components can be greatly decreased to approximately four-fifths. If even only one of the components can be reduced in the field of small household appliances, the reduced number of components leads to a greatly advantageous effect. Therefore, according to the present embodiment, the configuration can be simplified, and thus, component cost and assembly cost can be decreased.

Here, an assembly configuration of the inner blade assembly 5 will be described. First, the engagement claws 72 are inserted sequentially from below into the engagement hole 57 formed at a corresponding position in the movable inner blade base plate 51 of the movable inner blade 50 and the engagement hole 47 formed in the inner blade base plate 41 of the inner blade 40. In this state, the distal end of the engagement claws 72 is bent, thereby configuring the blade assembly 6 to which the inner blade 40, the movable inner blade 50, and the stationary plate 70 are fixed.

Similarly to the above-described first embodiment, the first projection 62 of the inner blade base 60 is internally fitted from below into the fitting holes (in the present embodiment, the fitting holes in combination of the fitting hole 74 of the stationary plate 70, the fitting hole 54 of the movable inner blade 50, and the fitting hole 44 of the inner blade 40, which communicate with each other while being formed at the same position) formed at a corresponding position in the blade assembly 6. According to this configuration, in a state where the center of the inner blade base 60 and the center of the blade assembly 6 (that is, the center of the stationary plate 70, the center of the movable inner blade 50, and the center of the inner blade 40) are aligned with each other, four members are restrained from moving (positioned) in the radial direction, and are fitted to each other.

As an example, the fitting hole 74 of the stationary plate 70, the fitting hole 54 of the movable inner blade 50, and the fitting hole 44 of the inner blade 40 are all formed in the same shape. Alternatively, as the blade assembly 6, a configuration is adopted in which the stationary plate 70, the movable inner blade 50, and the inner blade 40 in a state of being fixed to each other are fitted to the first projection 62 of the inner blade base 60. Accordingly, even if only any one member, for example, only the fitting hole 44 of the inner blade 40 is configured to have a shape which can be fitted to the first projection 62 without any gap and the fitting hole 74 of the stationary plate 70 and the fitting hole 54 of the movable inner blade 50 are configured to have larger inner diameter than the fitting hole 44 of the inner blade 40 (not illustrated), the blade assembly 6 can be positioned at a predetermined position in the radial direction.

Furthermore, in a state where the third projection 66 of the inner blade base 60 is inserted from below into the through-holes (in the present embodiment, the through-holes in combination of the through-hole 76 of the stationary plate 70, the through-hole 56 of the movable inner blade 50, and the through-hole 46 of the inner blade 40, which communicate with each other while being formed at the same position) formed at a corresponding position in the blade assembly 6, the blade assembly 6 is fixed to the inner blade base 60 by means of caulking (swaging). The inner blade base 60 (third projection 66) is formed using a resin material. Accordingly, the caulking in this case is thermal caulking.

According to the present embodiment, the extension portion 78 is brought into contact with the position of the base portion 52*d* of the movable small blade 52 of the movable inner blade 50 or the position in the vicinity thereof from below. In this manner, the contact position can be pinched (fixed without any gap) by the stationary plate 70 (that is, the extension portion 68) and the inner blade 40 (lower surface). In a case where the extension portion 78 is not brought into contact therewith as described above, the base portion 52*d* is separated from the inner blade 40 (lower surface). Consequently, there is a risky possibility that the movable small blade 52 may not obtain a predetermined elastic force, or a risky possibility that the base portion 52*d* or the vicinity thereof may be deformed if both of these are separated from each other to a large degree. However, according to the contact structure using the extension portion 78, it is possible to reliably perform an operation of the movable small blade 52, that is, an operation in which the movable small blade 52 is closely attached to the front end surface 42*b* of the small blade 42 by the elastic force, and an operation in which the movable small blade 52 vertically moves (slides) along the front end surface 42*b*.

As described above, according to the rotary electric shaver in the present invention, even in a case where the small blade of the inner blade and the corresponding outer blade employ a multiple track structure such as a so-called dual track structure, it is possible to realize a configuration having the movable small blade using a small number of components. More specifically, with regard to the inner blade assembly, as an example, the inner blade and the movable inner blade are fixed to the inner blade base in this order from above, thereby configuring the inner blade assembly including only the three components. That is, the configuration can employ the three components as a minimum unit. Alternatively, as another example, the inner blade, the movable inner blade, and the stationary plate are fixed to the inner blade base in this order from above, thereby configuring the inner blade assembly including only the four components. That is, the configuration can employ the four components as a minimum unit. Therefore, compared to the related art, the number of components can be reduced. Accordingly, the configuration can be simplified, and component cost and assembly cost can be decreased.

In addition, the configuration including the movable small blade enables the small blade to cut the hair entering the hair inlet after the hair is further drawn into the hair inlet compared to the initial hair entry state. Therefore, since deeper shaving is available, it is possible to prevent the hair from remaining unshaved, and it is possible to improve shaving comfortability.

In particular, for a multiple track structure, it is possible to realize a configuration in which the movable small blade is also disposed in the small blade close to the inner periphery. Therefore, deep shaving is available in the wider range.

The present invention is not limited to the above-described embodiments, and can be modified in various ways within the scope not departing from the present invention. In particular, an example has been described in which the rotary electric shaver has three sets of the dual track structure combination (blade unit) between the outer blade and the inner blade. However, the present invention is not limited thereto.

What is claimed is:

1. A rotary electric shaver comprising:

an outer blade whose upper surface functions as annular shaving surfaces having multiple hair inlets formed therein; and an inner blade having a plurality of small blades which rotate while coming into sliding contact with a lower surface of the outer blade from below the annular shaving surfaces, an inner blade base plate is partially erected to form the plurality of small blades disposed in a first row on a circumference adjacent to an outer periphery of the inner blade base plate and in a second row on a circumference adjacent to an inner periphery of the inner blade base plate, wherein there is provided a movable inner blade having a plurality of movable small blades which are vertically movable along at least a respective front end surface in a rotation direction of the plurality of small blades on the outer periphery of the inner blade base plate, and further comprising:

a stationary plate that comes into contact with a predetermined portion of the movable inner blade from below, wherein the inner blade, the movable inner blade and the stationary plate are fixed to an inner blade base in this order from above so that four components configure an inner blade assembly that is rotatably mounted relative to the outer blade, wherein the inner blade base has a first projection to which the inner blade, the movable inner blade, and the stationary plate are fitted so as to perform positioning in a radial direction of the inner blade and the movable inner blade and the stationary plate, and a second projection to which an outer blade assembly having an outer blade cover fixed to the center of the outer blade is fitted so as to perform positioning in the radial direction of the outer blade assembly, said first projection being formed in a cylindrical shape and said second projection being formed in a pillar shape wherein said first projection is displaced radially outwardly from the second projection, wherein respective center axes of the first projection and the second projection are arranged so as to be coaxial with a rotation axis of the inner blade assembly, wherein the inner blade base has multiple third projections which are erected radially outwardly from the first projection, wherein the inner blade, the movable inner blade and the stationary plate are fixed to the inner blade base by means of caulking in a state where the third projection is inserted from below into through-holes formed at a corresponding position in the blade assembly.

2. The rotary electric shaver according to claim 1, wherein the stationary plate has engagement claws in which a base plate of the stationary plate is partially erected to form the engagement claws so as to project upwardly, wherein in a state where the engagement claws are sequentially inserted from below into an engagement hole formed at a corresponding position in a movable inner blade base plate of the movable inner blade, and an engagement hole formed in the inner blade base plate of the inner blade, each distal end of the engagement claws is bent so as to configure a blade assembly to which the inner blade, the movable inner blade, and the stationary plate are fixed.

3. The rotary electric shaver according to claim 1, wherein an angle $\alpha$ of an erected angle of a front end surface in the rotation direction with respect to a plate surface of the inner blade base plate in each of the plurality of small blades is formed to be relatively small relative to an angle $\beta$ of an erected angle of a rear end surface in the rotation direction with respect to a plate surface of the movable inner blade base plate in each of the plurality of movable small blades that is formed to be relatively large relative to the angle $\alpha$ so that each of the plurality of movable small blades moves in a vertical direction with respect to each of the plurality of small blades in a state where a rear side upper end edge in the rotation direction of each of the plurality of movable small blades is always in linear contact with the front end surface in the rotation direction of each of the plurality of small blades.

* * * * *